US008831178B2

(12) United States Patent
Lemaitre

(10) Patent No.: US 8,831,178 B2
(45) Date of Patent: Sep. 9, 2014

(54) APPARATUS AND METHOD OF MANUFACTURING A THERMALLY STABLE CATHODE IN AN X-RAY TUBE

(75) Inventor: Sergio Lemaitre, Whitefish Bay, WI (US)

(73) Assignee: General Electric Company, Schenectady, NY (US)

( * ) Notice: Subject to any disclaimer, the term of this patent is extended or adjusted under 35 U.S.C. 154(b) by 266 days.

(21) Appl. No.: 13/540,714

(22) Filed: Jul. 3, 2012

(65) Prior Publication Data

US 2014/0010354 A1 Jan. 9, 2014

(51) Int. Cl.
*H01J 35/06* (2006.01)

(52) U.S. Cl.
USPC ..... 378/136

(58) Field of Classification Search
USPC ..... 378/119, 136, 134
See application file for complete search history.

(56) References Cited

U.S. PATENT DOCUMENTS 6,115,453 A 9/2000 Hell et al.
8,254,526 B2 * 8/2012 Hauttmann ..... 378/136
2009/0323898 A1 * 12/2009 Moore ..... 378/136
2010/0195797 A1 * 8/2010 Hauttmann ..... 378/136
2012/0027182 A1 * 2/2012 Canfield ..... 378/136
2012/0082300 A1 * 4/2012 Onken ..... 378/136

FOREIGN PATENT DOCUMENTS

WO 2009013677 A1 1/2009

* cited by examiner

*Primary Examiner* — Irakli Kiknadze
(74) *Attorney, Agent, or Firm* — Ziolkowski Patent Solutions Group, SC

(57) ABSTRACT

An x-ray imaging system includes a detector positioned to receive x-rays, an x-ray tube configured to generate x-rays toward the detector from a focal spot surface, the x-ray tube includes a target having the focal spot surface, a cathode support arm, and a cathode attached to the cathode support arm. The cathode includes a split cathode cup having a first portion and a second portion that is separate from the first portion, the first and second portions having respective first and second emitter attachment surfaces, and a flat emitter that is attached to the first and second emitter attachment surfaces such that, when an electrical current is provided to the first portion of the cathode cup, the current passes through the flat emitter and returns through the second portion of the cathode cup such that electrons emit from the flat emitter and toward the focal spot surface.

21 Claims, 5 Drawing Sheets

APPARATUS AND METHOD OF MANUFACTURING A THERMALLY STABLE CATHODE IN AN X-RAY TUBE

BACKGROUND OF THE INVENTION

Embodiments of the invention relate generally to x-ray imaging devices and, more particularly, to an x-ray tube having an improved cathode structure.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The data acquisition system then reads the signals received in the detector, and the system then translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes typically include an anode structure for the purpose of distributing the heat generated at a focal spot. An x-ray tube cathode provides an electron beam from an emitter that is accelerated using a high voltage applied across a cathode-to-anode vacuum gap to produce x-rays upon impact with the anode. The area where the electron beam impacts the anode is often referred to as the focal spot. Typically, the cathode includes one or more cylindrically wound filaments positioned within a cup for emitting electrons as a beam to create a high-power large focal spot or a high-resolution small focal spot, as examples. Imaging applications may be designed that include selecting either a small or a large focal spot having a particular shape, depending on the application.

Conventional cylindrically wound filaments, however, emit electrons in a complex pattern that is highly dependent on the circumferential position from which they emit toward the anode. Due to the complex electron emission pattern from a cylindrical filament, focal spots resulting therefrom can have non-uniform profiles that are highly sensitive to the placement of the filament within the cup. As such, cylindrically wound filament-based cathodes are manufactured having their filament positioned with very tight tolerances in order to meet the exacting focal spot requirements in an x-ray tube.

In order to generate a more uniform profile of electrons toward the anode to obtain a more uniform focal spot, cathodes having a flat emitter surface have recently been developed. Typically a flat emitter may take the form of a D-shaped filament that is a wound filament having the flat of the "D" facing toward the anode. Such a design emits a more uniform pattern of electrons and emits far fewer electrons from the rounded surface of the filament that is facing away from the anode (that is, facing toward the cup). D-shaped filaments, however, are expensive to produce (they are typically formed about a D-shaped mandrel) and typically require, as well, very tight manufacturing tolerances and separately biased focus electrodes in order to meet focal spot requirements.

Thus, in another example of a flat surface for forming a filament, a flat surface emitter (or a 'flat emitter') may be positioned within the cathode cup with the flat surface positioned orthogonal to the anode. A flat emitter is typically formed with a very thin material having electrodes attached thereto, which can be significantly less costly to manufacture compared to conventionally wound (cylindrical or D-shaped) filaments and may have a relaxed placement tolerance when compared to a conventionally wound filament.

Despite being quite thin (perhaps a few hundred microns in thickness), however, electrons nevertheless tend to emit from the edge of the flat emitter, causing a non-uniform emission profile that can result in a non-uniform focal spot. As such, flat emitters typically include separately biased focus electrodes in order to meet focal spot requirements, as well.

A flat emitter typically includes support legs to provide both structural support to the flat emitter as well as a path for providing electrical current to the emitter. Thus, the emitter can rise significantly in temperature relative to the surrounding focusing structure (i.e., the cathode cup), which can lead to thermal growth of the support legs and to a change in position of the flat emitter relative to its surrounding cup. Such motion can cause a change in the focal spot position and shape during operation of the x-ray tube, leading to drift of the modulation transfer function (MTF) which can cause image artifacts to occur.

In WO/2009/013677, for instance, an electron emitter design as shown in FIG. 6 is presented that may reduce the negative influence of thermal growth of the emitter support legs. This emitter has an outer part that is mechanically connected to the inner part constituting the emission surface. During thermal growth the outer and inner part move together, thus reducing the negative influence on the focal spot.

However, the electron emitter design described in /2009/013677 still allows a relative displacement of the emitter with respect to the cathode cup during thermal growth of the emitter legs thus negatively influencing focal spot position and shape during operation of the x-ray tube.

Therefore, it would be desirable to have an apparatus and method capable of reducing or eliminating the effects of thermal growth of the legs of a flat emitter in an x-ray imaging device.

BRIEF DESCRIPTION

Embodiments of the invention provides an apparatus and method that overcome the aforementioned drawbacks by providing for a thermally stable flat emitter within a cathode assembly.

In accordance with one aspect of the invention, an x-ray imaging system includes a detector positioned to receive x-rays, an x-ray tube configured to generate x-rays toward the detector from a focal spot surface, the x-ray tube includes a target having the focal spot surface, a cathode support arm, and a cathode attached to the cathode support arm. The cathode includes a split cathode cup having a first portion and a second portion that is separate from the first portion, the first portion having a first emitter attachment surface and the second portion having a second emitter attachment surface, and a flat emitter that is attached to the first emitter attachment surface and to the second emitter attachment surface such that, when an electrical current is provided to the first portion of the cathode cup, the current passes through the flat emitter and returns through the second portion of the cathode cup such that electrons emit from the flat emitter and toward the focal spot surface.

In accordance with another aspect of the invention, a method of manufacturing a cathode assembly for an x-ray tube includes providing an emitter having a planar surface from which electrons emit when an electrical current is passed therethrough, the emitter having a first attachment surface and a second attachment surface, providing a first portion of a cathode cup and a second portion of the cathode cup that is separate from the first portion of the cathode cup, attaching the first and second portions of the cathode cup to a cathode support structure of the x-ray tube such that the first and second portions of the cathode cup are electrically insulated from the cathode support structure, coupling a current supply to the first portion of the cathode cup, coupling a current return to the second portion of the cathode cup, attaching the first attachment surface of the flat emitter to the first portion of the cathode cup, and attaching the second attachment surface of the flat emitter to the second portion of the cathode cup such that, when a current is provided by the current supply, electrons emit from the flat emitter toward a target of the x-ray tube.

In accordance with yet another aspect of the invention, a cathode assembly for an x-ray tube includes a support structure, a first cathode cup component attached to the support structure, a second cathode cup component, separate from the first cathode cup component, attached to the support structure, a current supply electrically coupled to the first cathode cup component, a current return electrically coupled to the second cathode cup component, and a flat emitter attached to both the first cathode cup component and to the second cathode cup component such that, when an electrical current is provided to the first cathode cup component, the current passes through the flat emitter and returns through the second cathode cup component such that electrons emit from the flat emitter and toward a focal spot surface of the x-ray tube.

Various other features and advantages will be made apparent from the following detailed description and the drawings.

BRIEF DESCRIPTION OF THE DRAWINGS

The drawings illustrate one or more embodiments presently contemplated for carrying out embodiments of the invention.

In the drawings.

DETAILED DESCRIPTION

Figure 1:
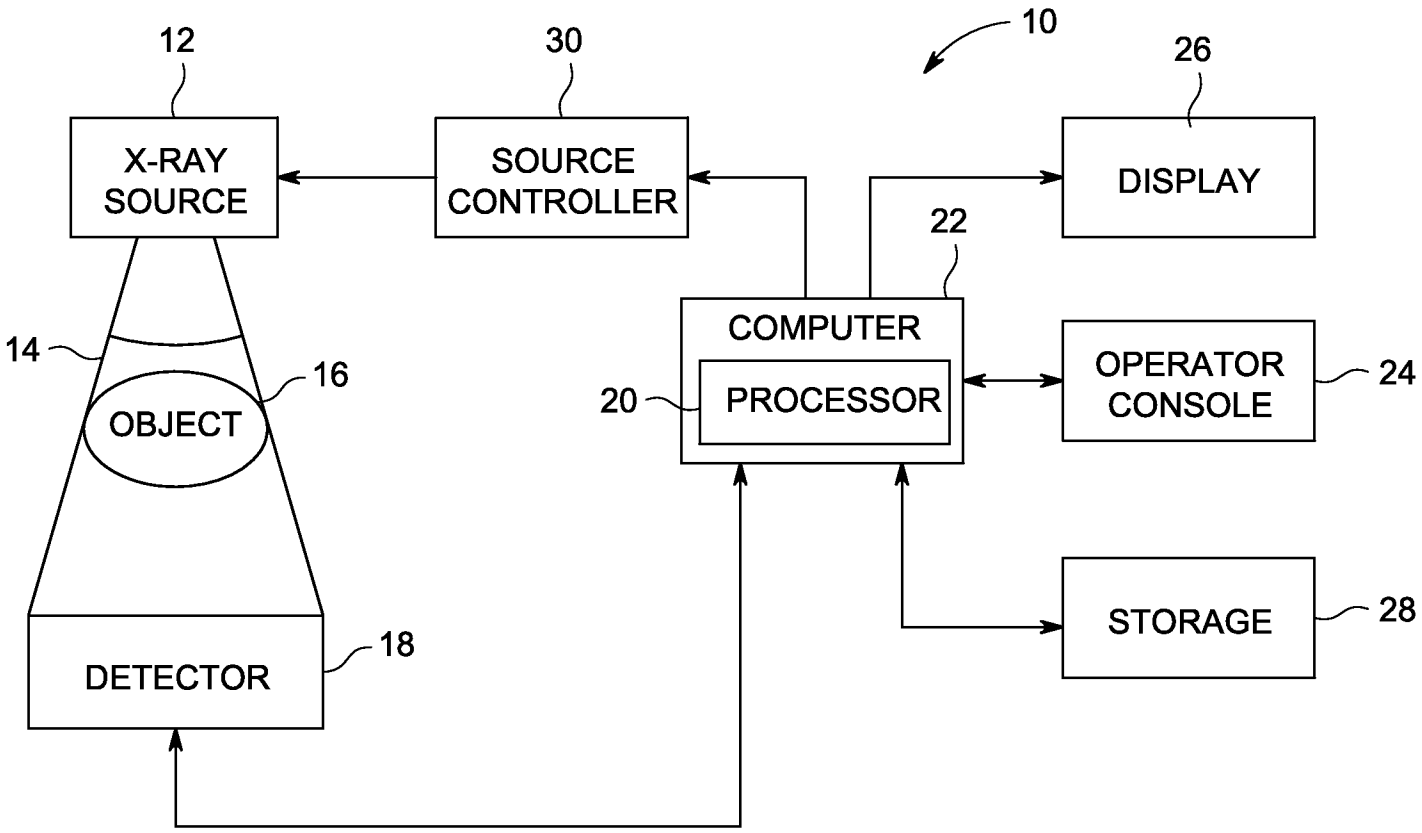
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with embodiments of the invention. It will be appreciated by those skilled in the art that embodiments of the invention are applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from embodiments of the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, flash memory, compact discs, etc. The operator may also use console 24 to provide commands and instructions to computer 22 for controlling a source controller 30 that provides power and timing signals to x-ray source 12.

Figure 2:
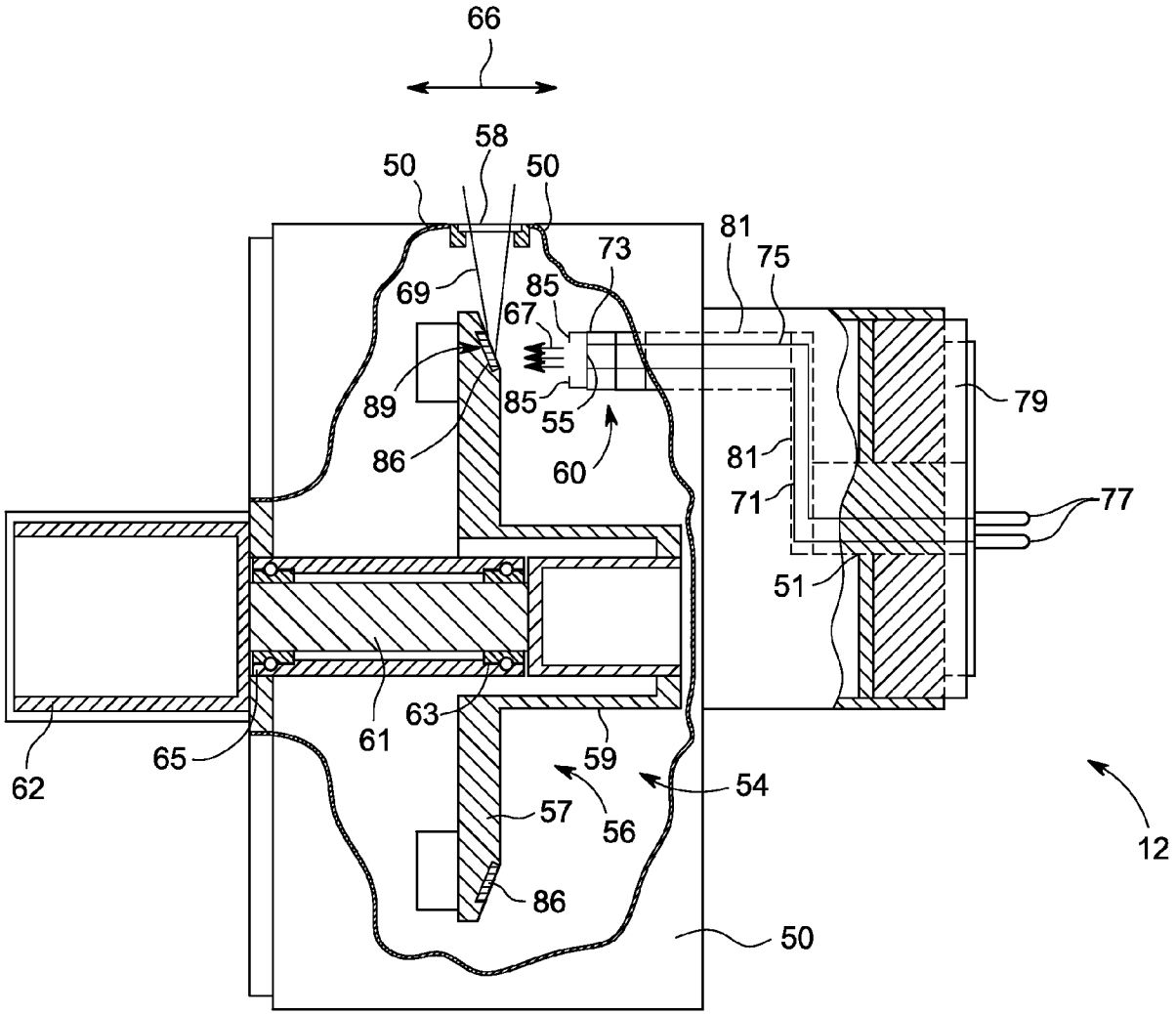
FIG. 2 is a cross-sectional view of an x-ray tube that incorporates embodiments of the invention.

FIG. 2 illustrates a cross-sectional view of an x-ray tube 12 incorporating embodiments of the invention. X-ray tube 12 includes a frame 50 that encloses a vacuum region 54, and an anode 56 and a cathode assembly 60 are positioned therein. Anode 56 includes a target 57 having a target track 86, and a target hub 59 attached thereto. Terms "anode" and "target" are to be distinguished from one another, where target typically includes a location, such as a focal spot, wherein electrons impact a refractory metal with high energy in order to generate x-rays, and the term anode typically refers to an aspect of an electrical circuit which may cause acceleration of electrons theretoward. Target 56 is attached to a shaft 61 supported by a front bearing 63 and a rear bearing 65. Shaft 61 is attached to a rotor 62. Cathode assembly 60 includes a cathode cup 73 and a flat emitter or filament 55 coupled to a current supply lead 71 and a current return 75 that each pass through a center post 51.

Feedthrus 77 pass through an insulator 79 and are electrically connected to electrical leads 71 and 75. X-ray tube 12 includes a window 58 typically made of a low atomic number metal, such as beryllium, to allow passage of x-rays therethrough with minimum attenuation. Cathode assembly 60 includes a support arm 81 that supports cathode cup 73, flat emitter 55, as well as other components thereof. Support arm 81 also provides a passage for leads 71 and 75. Cathode assembly 60 includes deflection Z-electrodes 85 that are electrically insulated from cathode cup 73 and electrically connected via leads (not shown) through support arm 81 and through insulator 79 in a fashion similar to that shown for feedthrus 77.

In operation, target 56 is spun via a stator (not shown) external to rotor 62. An electric current is applied to flat emitter 55 via feedthrus 77 to heat emitter 55 and emit electrons 67 therefrom. A high-voltage electric potential is applied between anode 56 and cathode 60, and the difference therebetween accelerates the emitted electrons 67 from cathode 60 to anode 56. Electrons 67 impinge target 57 at target track 86 and x-rays 69 emit therefrom at a focal spot 89 and pass through window 58.

According to one embodiment, a rapidly alternating bias voltage (a few kHz or more) is applied to Z-electrodes 85 that cause electrons to deflect (referred to in the art as 'wobble' or a 'flying focal spot') which correspondingly causes the location of focal spot 89 to shift. The rapidly shifting position of focal spot 89 can be taken advantage of to improve resolution and image quality, as is known in the art. Further, Z-electrodes 85 are illustrated in a position such that, when the bias voltage is alternatingly applied thereto, the shift of the focal spot is along the radial direction of target 57, causing focal spot 89 to rapidly alternate in position on target track 86 and emit from alternate locations along a slice or Z-direction 66, as is known in the art. In an alternate embodiment, instead of or in addition to Z-electrodes 85, width electrodes may be included as well (not shown) which are positioned fore and aft of flat emitter 55 in FIG. 2. The fore and aft electrodes can likewise be rapidly biased in order to rapidly wobble focal spot 89 along a width direction of focal spot 89 (in and out of the page) which can be taken advantage of to improve resolution and image quality, as also is known in the art.

Figure 3:
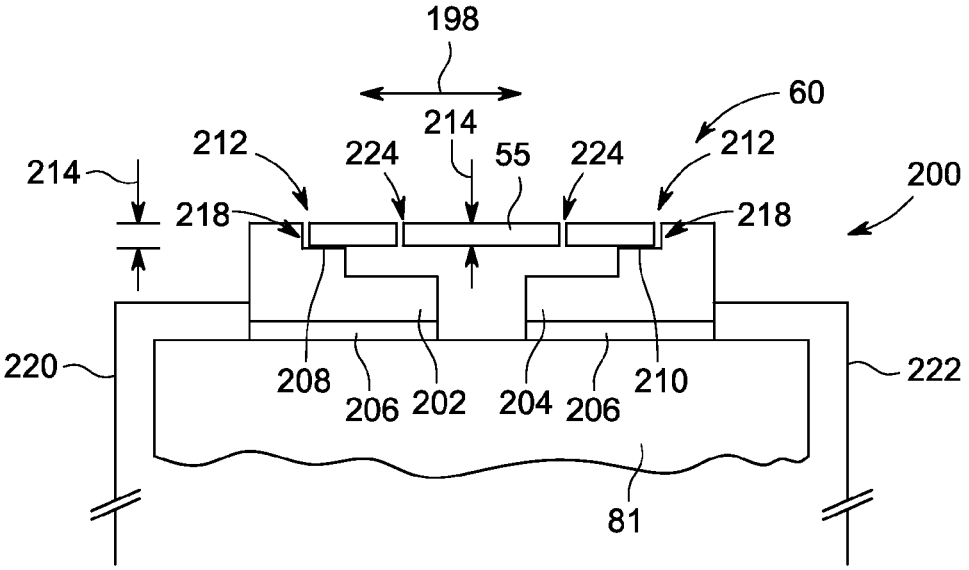
FIG. 3 is an end view of a cathode according to an embodiment of the invention.

Referring now to FIG. 3, a portion of cathode assembly 60 is illustrated therein. That illustrated in FIG. 3 is illustrated from a different vantage point than that illustrated in FIG. 2. That is, width direction 198 of FIG. 3 corresponds to a width of focal spot 89 of FIG. 2, which as stated passes in and of the page of FIG. 2. Cathode assembly 60 includes cathode support arm 81 and a split cathode cup 200 that includes a first portion 202 and a second portion 204 that are connected to cathode support arm 81 and having an insulating material 206 positioned to insulate cup portions 202, 204 from cathode support arm 81. Flat emitter 55 is positioned therein and is electrically coupled to cup portions 202, 204 at respective first and second attachment surfaces 208, 210. According to embodiments of the invention, flat emitter 55 is attached at first and second attachment surfaces using laser brazing or laser welding, as examples. According to one embodiment, first and second portions of the split cathode cup 202, 204 each include a step or cutout portion 212 having a depth 214 that is comparable to a thickness 216 of flat emitter 55. In such fashion, when electrons are caused to emit from a planar surface of flat emitter 55, such as electrons 67 illustrated in FIG. 2, according to this embodiment electrons 67 are prevented from emitting from edges 218.

Electrical current is carried to flat emitter 55 via a current supply line 220 and from flat emitter 55 via a current return line 222 which are electrically connected to source controller 30 and controlled by computer 22 of system 10 in FIG. 1. Incidentally, supply and return lines 220 and 222 correspond to current supply lead 71 and current return 75 illustrated in FIG. 2. And, although supply and return lines 220, 222 are illustrated as external to cathode support arm 81, according to other embodiments, supply and return lines 220, 222 may pass through cathode support arm 81 and insulating material 206.

Figure 4:
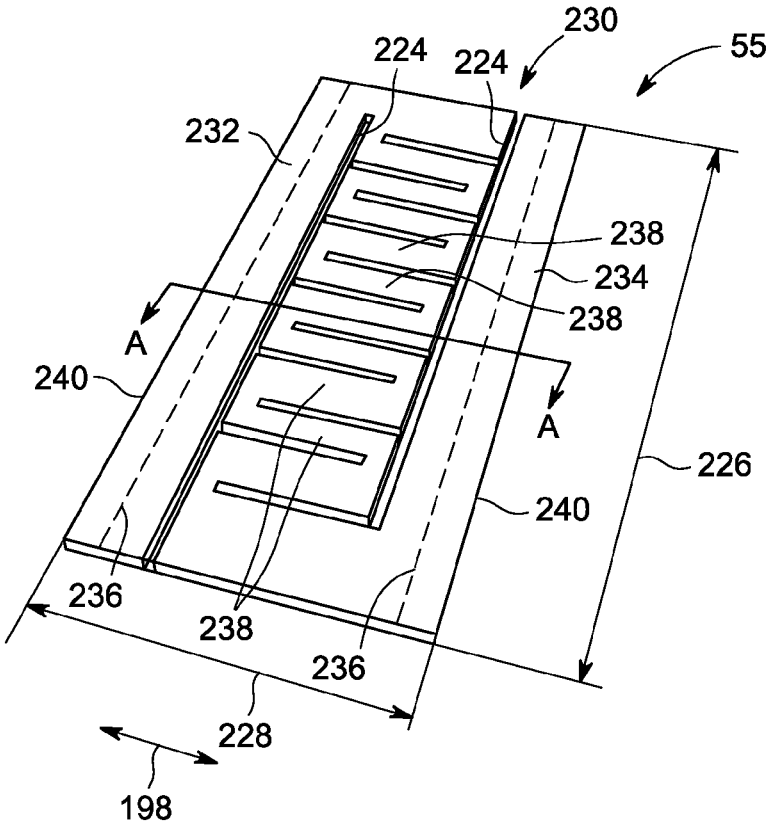
FIG. 4 is a perspective view of a flat emitter that is positionable in a cathode assembly according to embodiments of the invention.

Flat emitter 55 is illustrated in FIG. 3 as having breaks 224 therein. As illustrated in FIG. 4, however, flat emitter 55 is a single piece fabricated in such fashion that current passes from one edge, along its length, to another edge. That is, FIG. 3 illustrates a cross-section of cathode assembly 60 and illustrated at location "A", for instance, in FIG. 4. As can be seen, breaks 224 extend along a length 226 of flat emitter 55, but in a fashion that leaves flat emitter 55 as a single piece. Flat emitter 55 includes length 226 and a width 228. Length 226 corresponds to the profile view of flat emitter 55 as shown in FIG. 2, and width 228 extends along width direction 198, and length 226 is greater than width 228.

Flat emitter 55 includes a cutout pattern 230 that includes a ribbon-shaped or 'back-and-forth' pattern of legs along which current passes when a current is provided thereto. Flat emitter 55 includes first and second contact regions 232, 234 that are bounded by boundaries 236 and are located at first and second locations along width 228. First and second contact regions 232 and 234 correspond to first and second attachment surfaces 208 and 210 of split cathode 200, and may be attached thereto using spot welds, line welds, braze, and other known methods. As stated, referring to FIGS. 3 and 4, a current is applied to first portion 202, which thereby flows to flat emitter 55 through surface 208 and to first contact region 232, and then along the back-and-forth pattern of cutout pattern 230 before returning to second portion 204, through second contact region 234 and attachment surface 210, then passing to current return line 222.

Pattern 230 includes a number of rungs or legs 238 which traverse back-and-forth and along which current travels. Flat emitter 55 typically ranges in thickness from 200 to 500 microns but is not limited thereto. In a preferred embodiment the thickness is 300 microns or less, however one skilled in the art will recognize that the preferred thickness is dependent also upon the widths of legs 238. That is, as known in the art, the electrical resistance within legs 238 varies both as a function of a width of each leg 238 and as a thickness of flat emitter 55 (i.e., as a function of its cross-sectional area). According to the invention the width of each leg 238 may be the same within all legs or may be changed from leg to leg, depending on emission characteristics and performance requirements.

Flat emitter 55 is positioned within cathode assembly 60 as illustrated in FIG. 3 and as also illustrated in x-ray tube 10 of FIG. 2. Thus when current is provided to flat emitter 55, the current is caused to flow back and forth along legs 238, and the high kV applied between cathode assembly 60 and anode 56 thereby causes electrons 67 to emit from legs 238 and toward focal spot 89. As commonly known in the art, the emission pattern of electrons 67 is dependent upon a number of factors, which include but are not limited to the width of legs 238, the thickness of the emitter 55, the amount of current supplied, and the magnitude of kV applied between cathode assembly 60 and anode 56. That is, as known in the art the emission is dependent upon the temperature reached by a filament, such as flat filament 55. Thus, when current is input to filament 55, although the higher temperatures are reached in the pathways that include legs 238, it is also understood that other portions of flat filament reach high temperature as well that, in some embodiments, may cause electrons to emit from the other portions as well. For instance, electrons may emit from first and second contact regions 232 and 234 or from edges 218 of flat emitter 55.

In order to mitigate or reduce electron emission from edges 240 (also corresponding to edged 218 of FIG. 3), edges 240 may be intentionally obscured such that emission is minimized. Thus, as illustrated in FIG. 3, flat emitter 55 is positioned within steps or cutouts 212 having depth 214 that equals or exceeds thickness 216 of flat filament 55. As such, the electron optics of the disclosed invention provide an improved method of positioning a flat emitter within a cathode assembly for reasons that include but are not limited to the fact that the flat emitter is hard-connected to the split cathode cup in order that, as the cathode cup thermally grows and shrinks during use (heating and cooling), the flat emitter 55 moves with it, preventing its relative location with respect to the surrounding cathode cup from changing. As known in the art, focusing is a result in part of the filament and its position in respect to surrounding biased components, thus as the flat filament moves along with the cathode cup, the relative field changes are minimized and the emission of electrons are minimized.

Further, as known in the art, electrons emitted from flat filament 55 may be deflected using deflection electrodes in order to cause the focal spot to wobble at a high rate of speed in order to improve image resolution. Thus, electrodes may be provided proximate flat filament 55 that provide deflection capability to electrons 67 in either a Z-direction, an X-direction, or both. As shown in FIG. 2 and as discussed above, electrodes 85 are positioned on both ends of cathode assembly 60 and along the length thereof, which can be alternatingly biased in order to cause deflection of focal spot 89 such that wobble of the focal spot occurs along Z-direction 66. However, deflection electrodes may be provided in the other plane, in and out of the page of FIG. 2, in order to provide a wobble capability in the X-direction as well.

Figure 5:
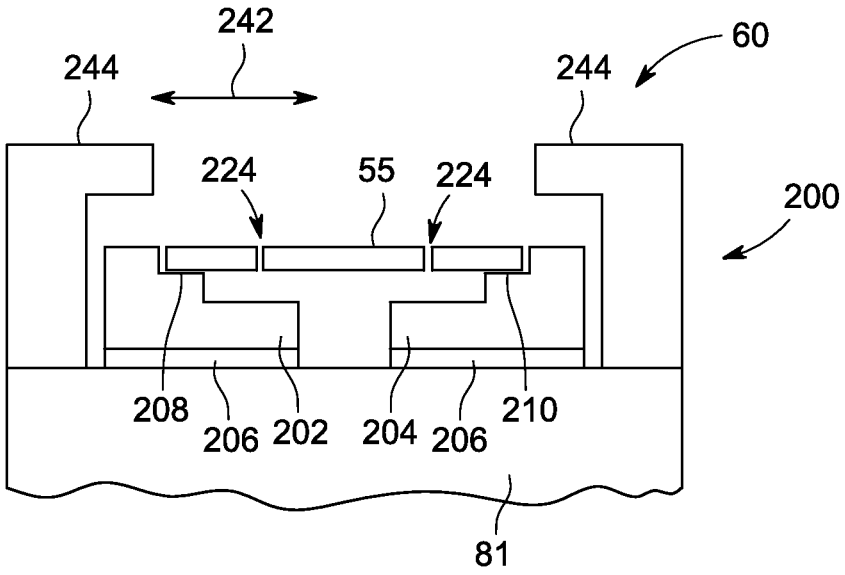
FIG. 5 is cathode assembly illustrating x-wobble electrodes according to an embodiment of the invention.

Referring now to FIG. 5, the cathode assembly of FIG. 3 is illustrated therein. As stated, cathode assembly 60 includes current supply and return lines to provide current to flat emitter 55 (not illustrated in FIG. 5). However, as also stated, other methods are available, according to the invention, to provide current to flat emitter 55 such as providing pass-thrus in support arm 81. Also, cathode assembly 60 may include a capability to wobble the focal spot in an X-direction 242 as well within x-ray tube 12. Thus, cathode assembly 60 may also include x-electrodes 244 that can be insulated from cathode support arm 81 (insulation not shown) and alternatingly biased (bias leads not shown) in order to rapidly wobble electrons 67.

Thus, emitter 55 is mounted to a larger heat sink material (i.e., first portion 202 and second portion 204 of split cathode cup 200) which is less affected, due to the thermal mass of portions 202, 204, compared to conventional legs used to mount cathode filaments. Further, flat emitter 55 is locked to the focusing structure, which causes flat emitter 55 to move along with the cathode cup as the cathode cup heats and cools during operation, reducing or eliminating motion of the flat emitter 55 relative to the surrounding focusing structure.

Figure 6:
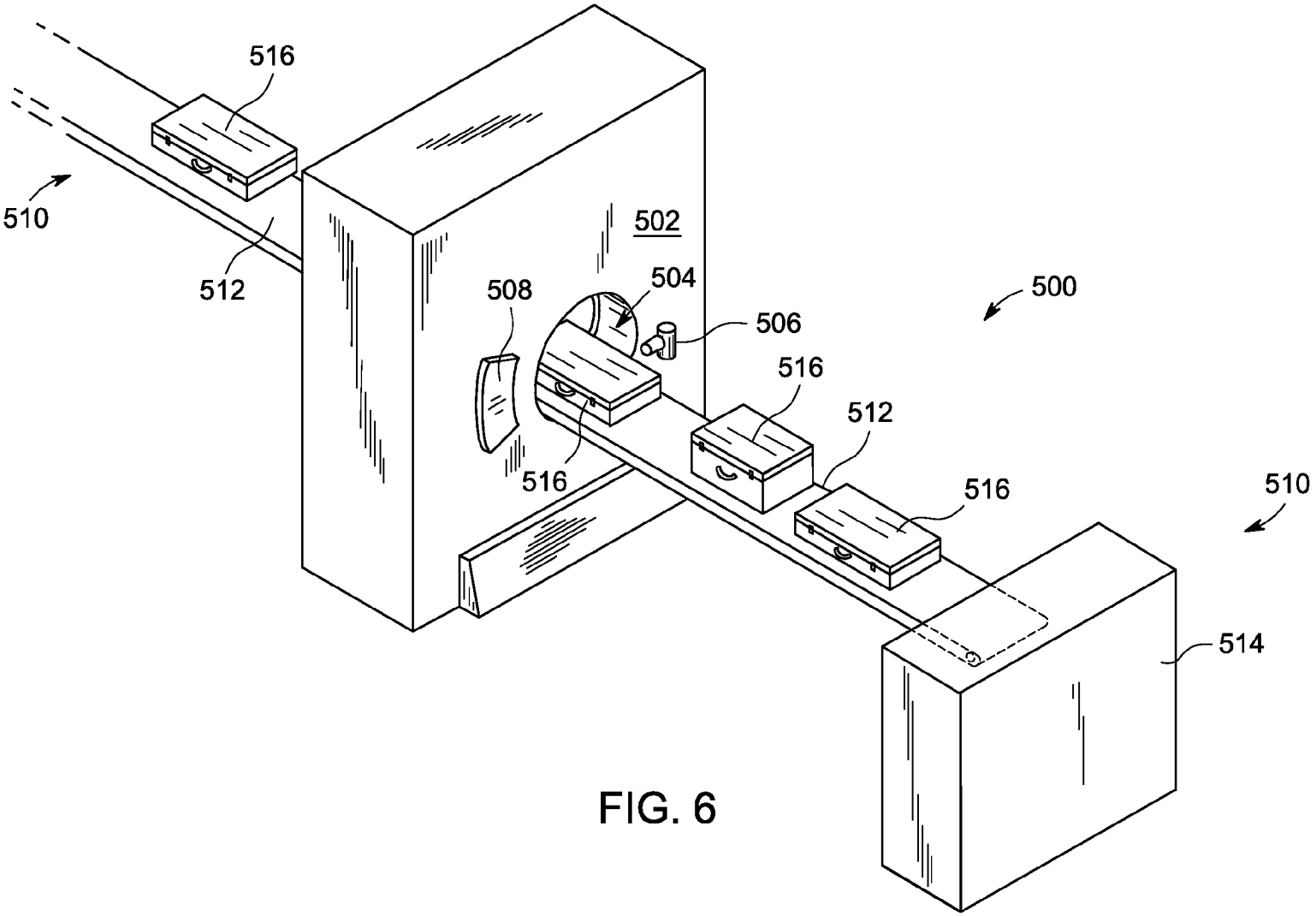
FIG. 6 is a pictorial view of an x-ray system for use with a non-invasive package inspection system that can benefit from incorporation of an embodiment of the invention.

FIG. 6 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

According to one embodiment of the invention, an x-ray imaging system includes a detector positioned to receive x-rays, an x-ray tube configured to generate x-rays toward the detector from a focal spot surface, the x-ray tube includes a target having the focal spot surface, a cathode support arm, and a cathode attached to the cathode support arm. The cathode includes a split cathode cup having a first portion and a second portion that is separate from the first portion, the first portion having a first emitter attachment surface and the second portion having a second emitter attachment surface, and a flat emitter that is attached to the first emitter attachment surface and to the second emitter attachment surface such that, when an electrical current is provided to the first portion of the cathode cup, the current passes through the flat emitter and returns through the second portion of the cathode cup such that electrons emit from the flat emitter and toward the focal spot surface.

In accordance with another embodiment of the invention, a method of manufacturing a cathode assembly for an x-ray tube includes providing an emitter having a planar surface from which electrons emit when an electrical current is passed therethrough, the emitter having a first attachment surface and a second attachment surface, providing a first portion of a cathode cup and a second portion of the cathode cup that is separate from the first portion of the cathode cup, attaching the first and second portions of the cathode cup to a cathode support structure of the x-ray tube such that the first and second portions of the cathode cup are electrically insulated from the cathode support structure, coupling a current supply to the first portion of the cathode cup, coupling a current return to the second portion of the cathode cup, attaching the first attachment surface of the flat emitter to the first portion of the cathode cup, and attaching the second attachment surface of the flat emitter to the second portion of the cathode cup such that, when a current is provided by the current supply, electrons emit from the flat emitter toward a target of the x-ray tube.

In accordance with yet another embodiment of the invention, a cathode assembly for an x-ray tube includes a support structure, a first cathode cup component attached to the support structure, a second cathode cup component, separate from the first cathode cup component, attached to the support structure, a current supply electrically coupled to the first cathode cup component, a current return electrically coupled to the second cathode cup component, and a flat emitter attached to both the first cathode cup component and to the second cathode cup component such that, when an electrical current is provided to the first cathode cup component, the current passes through the flat emitter and returns through the second cathode cup component such that electrons emit from the flat emitter and toward a focal spot surface of the x-ray tube.

Embodiments of the invention have been described in terms of the preferred embodiment(s), and it is recognized that equivalents, alternatives, and modifications, aside from those expressly stated, are possible and within the scope of the appending claims.

What is claimed is:

1. An x-ray imaging system comprising:

a detector positioned to receive x-rays;

an x-ray tube configured to generate x-rays toward the detector from a focal spot surface, the x-ray tube comprising:

a target having the focal spot surface;

a cathode support arm; and a cathode attached to the cathode support arm, the cathode comprising:

a split cathode cup having a first portion and a second portion that is separate from the first portion, the first portion having a first emitter attachment surface and the second portion having a second emitter attachment surface; and a flat emitter that is attached to the first emitter attachment surface and to the second emitter attachment surface such that, when an electrical current is provided to the first portion of the cathode cup, the current passes through the flat emitter and returns through the second portion of the cathode cup such that electrons emit from the flat emitter and toward the focal spot surface.

2. The imaging system of claim 1 wherein:

the flat emitter comprises a cut-out pattern such that a back-and-forth current path is formed in the flat emitter.

3. The imaging system of claim 2 wherein:

the flat emitter is attached to the first emitter attachment surface extending along a length and at a first width location of the flat emitter;

the flat emitter is attached to the second emitter attachment surface extending along the length at a second width location of the flat emitter; and when the electrical current is provided and passes through the flat emitter, the current passes along the back-and-forth current path of the flat emitter.

4. The imaging system of claim 2 wherein the flat emitter has a thickness that is less than 300 microns.

5. The imaging system of claim 1 wherein the x-ray tube further comprises electrodes positioned proximate to the cathode such as to control at least one of a direction and intensity of the electrons that emit from the flat emitter when a bias voltage is applied to the electrodes.

6. The imaging system of claim 1 wherein the first portion and the second portion of the split cathode cup are each attached to the cathode support arm such that they are electrically insulated therefrom.

7. The imaging system of claim 1 wherein the first and second portions of the split cathode cup each include respective first and second cut-out steps that are approximately a depth that is the same as a thickness of the flat emitter such that:

the first emitter attachment surface is formed of the first step in the first portion of the split cathode cup; and the second emitter attachment surface is formed of the second step in the second portion of the split cathode cup.

8. A method of manufacturing a cathode assembly for an x-ray tube comprising:

providing an emitter having a planar surface from which electrons emit when an electrical current is passed therethrough, the emitter having a first attachment surface and a second attachment surface;

providing a first portion of a cathode cup and a second portion of the cathode cup that is separate from the first portion of the cathode cup;

attaching the first and second portions of the cathode cup to a cathode support structure of the x-ray tube such that the first and second portions of the cathode cup are electrically insulated from the cathode support structure;

coupling a current supply to the first portion of the cathode cup;

coupling a current return to the second portion of the cathode cup;

attaching the first attachment surface of the flat emitter to the first portion of the cathode cup; and attaching the second attachment surface of the flat emitter to the second portion of the cathode cup such that, when a current is provided by the current supply, electrons emit from the flat emitter toward a target of the x-ray tube.

9. The method of claim 8 comprising:

attaching the first attachment surface of the flat emitter to the first portion of the cathode cup via one of laser brazing and laser welding; and attaching the second attachment surface of the flat emitter to the second portion of the cathode cup via one of laser brazing and laser welding.

10. The method of claim 8 wherein the emitter comprises:

a ribbon-shaped cuttout pattern having back-and-forth legs that extend along the width of the emitter.

11. The method of claim 10 wherein:

the first attachment surface extends along a length of the emitter at a first width location of the emitter;

the second attachment surface extends along the length of the emitter at a second width location of the emitter; and when current is provided by the current supply the current passes from the first portion of the cathode cup, to the first attachment surface of the flat emitter, through the back-and-forth legs of the ribbon-shaped cuttout pattern, through the second attachment surface of the flat emitter, and to the second portion of the cathode cup as the return current.

12. The method of claim 10 wherein the emitter has a thickness that is less than 300 microns.

13. The method of claim 8 comprising attaching electrodes to the cathode assembly and proximate the first and second portions of the cathode cup such that the electrons emitted from the flat emitter are deflected in one of a length direction and a width direction of the flat emitter when a bias voltage is applied to the deflection electrodes.

14. The method of claim 8 comprising forming a first cut-out in the first portion of the cathode cup and a second cuttout in the second portion of the cathode cup, each of the first and second cuttouts having a depth that is comparable to a thickness of the emitter such that:

the first attachment surface is formed of the first cuttout; and the second attachment surface is formed of the second cuttout.

15. A cathode assembly for an x-ray tube comprising:

a support structure;

a first cathode cup component attached to the support structure;

a second cathode cup component, separate from the first cathode cup component, attached to the support structure;

a current supply electrically coupled to the first cathode cup component;

a current return electrically coupled to the second cathode cup component; and a flat emitter attached to both the first cathode cup component and to the second cathode cup component such that, when an electrical current is provided to the first cathode cup component, the current passes through the flat emitter and returns through the second cathode cup component such that electrons emit from the flat emitter and toward a focal spot surface of the x-ray tube.

16. The cathode assembly of claim 15 wherein:

the flat emitter comprises a cuttout pattern such that a back-and-forth current path is formed in the flat emitter.

17. The cathode assembly of claim 16 wherein:

the flat emitter is attached to the first cathode cup component extending along a length and at a first width location of the flat emitter;

the flat emitter is attached to the second cathode cup component extending along the length and at a second width location of the flat emitter; and when the electrical current is provided and passes through the flat emitter, the current passes along the back-and-forth current path of the flat emitter.

18. The cathode assembly of claim 15 wherein the flat emitter has a thickness that is less than 300 microns.

19. The cathode assembly of claim 15 wherein the cathode assembly further comprises deflection electrodes positioned proximate the first and second cathode cups such that the electrons that emit from the flat emitter are deflected along one of a length and a width of the flat emitter when a bias voltage is applied to the deflection electrodes.

20. The cathode assembly of claim 15 wherein the first cathode cup component and the second cathode cup component are each attached to the support structure such that they are electrically insulated therefrom.

21. The cathode assembly of claim 15 wherein the first and second cathode cup components each include respective first and second cuttout steps such that:

the flat emitter is attached to the first cathode cup component within the first cuttout step and attached to the second cathode cup component within the second cuttout step.

* * * * *